US007080681B2

(12) United States Patent
Wert

(10) Patent No.: US 7,080,681 B2
(45) Date of Patent: Jul. 25, 2006

(54) HEAT PIPE COMPONENT DEPLOYED FROM A COMPACT VOLUME

(75) Inventor: Kevin L. Wert, Halifax, PA (US)

(73) Assignee: Thermal Corp., Wilmington, DE (US)

( * ) Notice: Subject to any disclaimer, the term of this patent is extended or adjusted under 35 U.S.C. 154(b) by 142 days.

(21) Appl. No.: 10/792,198

(22) Filed: Mar. 3, 2004

(65) Prior Publication Data

US 2005/0194122 A1 Sep. 8, 2005

(51) Int. Cl.
*B60H 1/00* (2006.01)

(52) U.S. Cl. ..... 165/104.21; 165/41; 244/57; 244/171.8

(58) Field of Classification Search ..... 165/41, 165/46; 244/158 R, 159, 57, 171.8
See application file for complete search history.

(56) References Cited

U.S. PATENT DOCUMENTS 3,490,718 A 1/1970 Vary
4,765,396 A 8/1988 Seidenberg
4,832,113 A * 5/1989 Mims et al. ..... 165/41
4,921,041 A 5/1990 Akachi
5,027,892 A * 7/1991 Bannon et al. ..... 165/41
5,036,905 A * 8/1991 Eninger et al. ..... 165/41
5,586,441 A 12/1996 Wilson et al.
5,699,668 A 12/1997 Cox
5,725,049 A 3/1998 Swanson et al.
5,732,765 A * 3/1998 Drolen et al. ..... 165/41
5,743,325 A 4/1998 Esposto
5,787,969 A 8/1998 Drolen et al.
5,921,315 A 7/1999 Dinh
6,220,548 B1 * 4/2001 Hyman ..... 244/172.6
6,227,288 B1 5/2001 Gluck et al.
6,269,865 B1 8/2001 Huang
6,595,470 B1 * 7/2003 Keeler et al. ..... 244/172.6
6,597,573 B1 7/2003 Gummin
6,626,231 B1 * 9/2003 Cluzet et al. ..... 165/41

* cited by examiner

*Primary Examiner*—Terrell McKinnon
(74) *Attorney, Agent, or Firm*—Duane Morris LLP

(57) ABSTRACT

A component of a heat pipe assembly (100) has hollow fluid transport sections (108) communicating with hollow bendable fluid transport sections (110); the bendable fluid transport sections (110) being bendable to deploy the transport sections (108) from a compact volume.

15 Claims, 7 Drawing Sheets

HEAT PIPE COMPONENT DEPLOYED FROM A COMPACT VOLUME

FIELD OF THE INVENTION

The invention relates to a heat pipe assembly that is deployed from a compact volume, and more particularly, to a component of a heat pipe assembly with a reduced compact volume for shipping and handling.

BACKGROUND

A loop heat pipe assembly may require a lengthy condenser section for adequate heat transfer. However, the lengthy condenser section may be too long to fit within a maximum packaging volume that is set in cubic inches, as a requirement for shipping and handling. Thus, a need exists for a component of a heat pipe assembly that assumes a compact volume for packaging, and that deploys to a length that would exceed the packaging volume limitations. U.S. Pat. No. 3,490,718 discloses a radiator that can be folded or rolled up, without disclosing how the radiator is packaged or how the radiator is deployed.

Further, it would be desirable to have a component of a heat pipe assembly that would assume a number of dimensional configurations, straight or curvilinear for example, with a serpentine shape, a U-shape or J-shape, for example, to route the heat pipe assembly away from spatial obstacles.

SUMMARY OF THE INVENTION

The invention is a component of a heat pipe assembly that has bendable sections, which allow the component to assume a number of dimensional configurations. The component can be reduced to a compact configuration, for example, to fit within a maximum packaging volume, and can be deployed to a length that exceeds the maximum packaging volume. The component according to the invention allows a heat pipe of larger size and greater effectiveness than a heat pipe that would be restricted in size by its packaging dimensions.

DRAWING DESCRIPTION

Embodiments of the invention will now be described by way of example with reference to the accompanying drawings.

DETAILED DESCRIPTION

Figure 1:
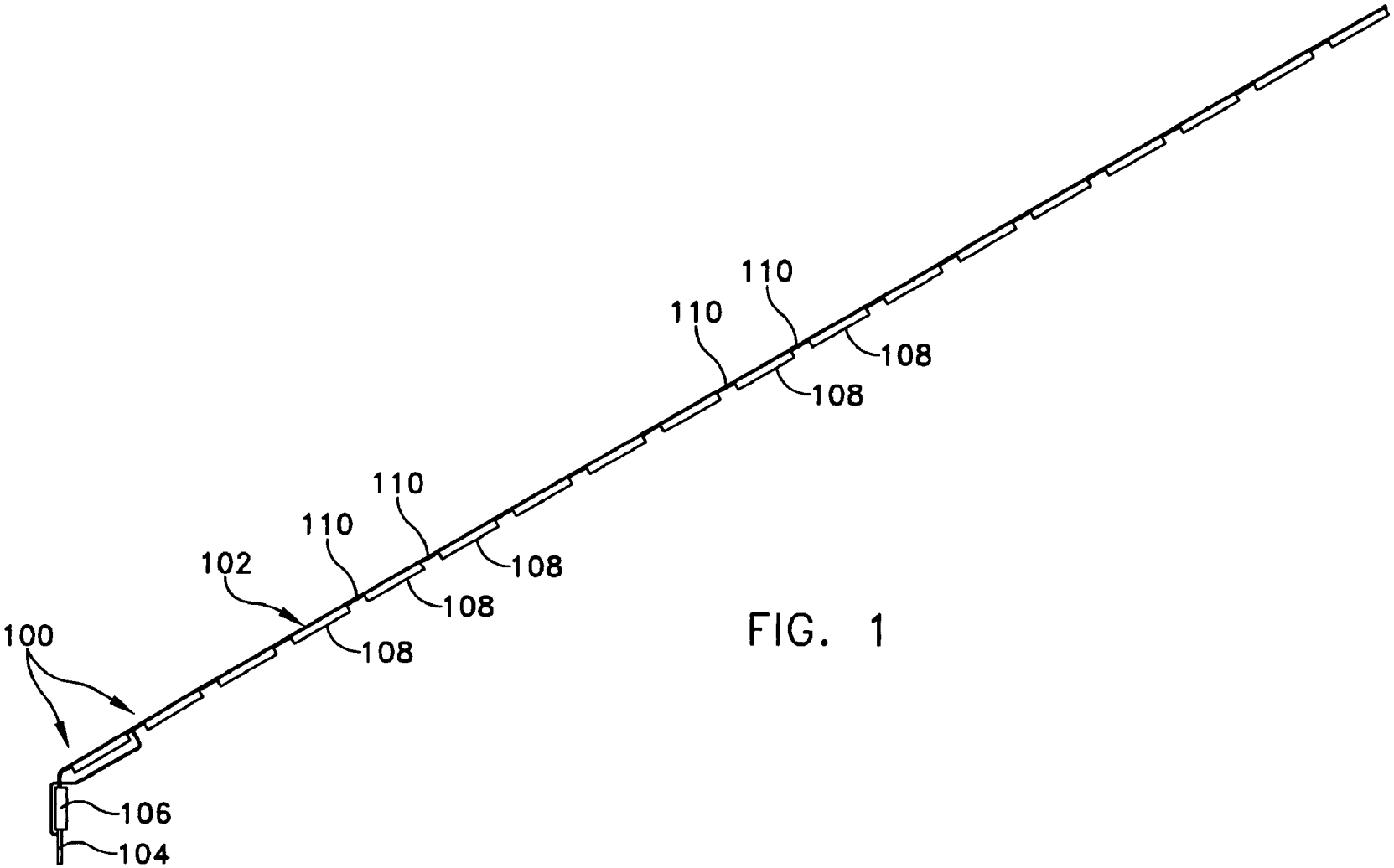
FIG. 1 is a side view of a heat pipe assembly with a deployed condenser component.

With reference to FIG. 1, an embodiment of a heat pipe assembly (100) has a condenser end with an elongated condenser (102). An evaporator end of the heat pipe assembly (100) has an evaporator (104) with a compensation chamber (106). The evaporator (104) and the compensation chamber (106) are of known construction. The condenser (102) is a component according to the invention.

The condenser (102) has multiple rigid condenser sections (108). At locations where flexibility is desired, bendable condenser sections (110) are connected to the rigid condenser sections (108). The rigid sections (108) are relatively more rigid than the bendable sections (110). The bendable sections (110) are more easily bent than the relatively rigid sections (108). In a continuous condenser (102), the bendable sections (110) connect the rigid sections (108), one to another. For example, an embodiment of the condenser (102) has an alternating series of rigid condenser sections (108) and bendable condenser sections (110).

Figure 2:
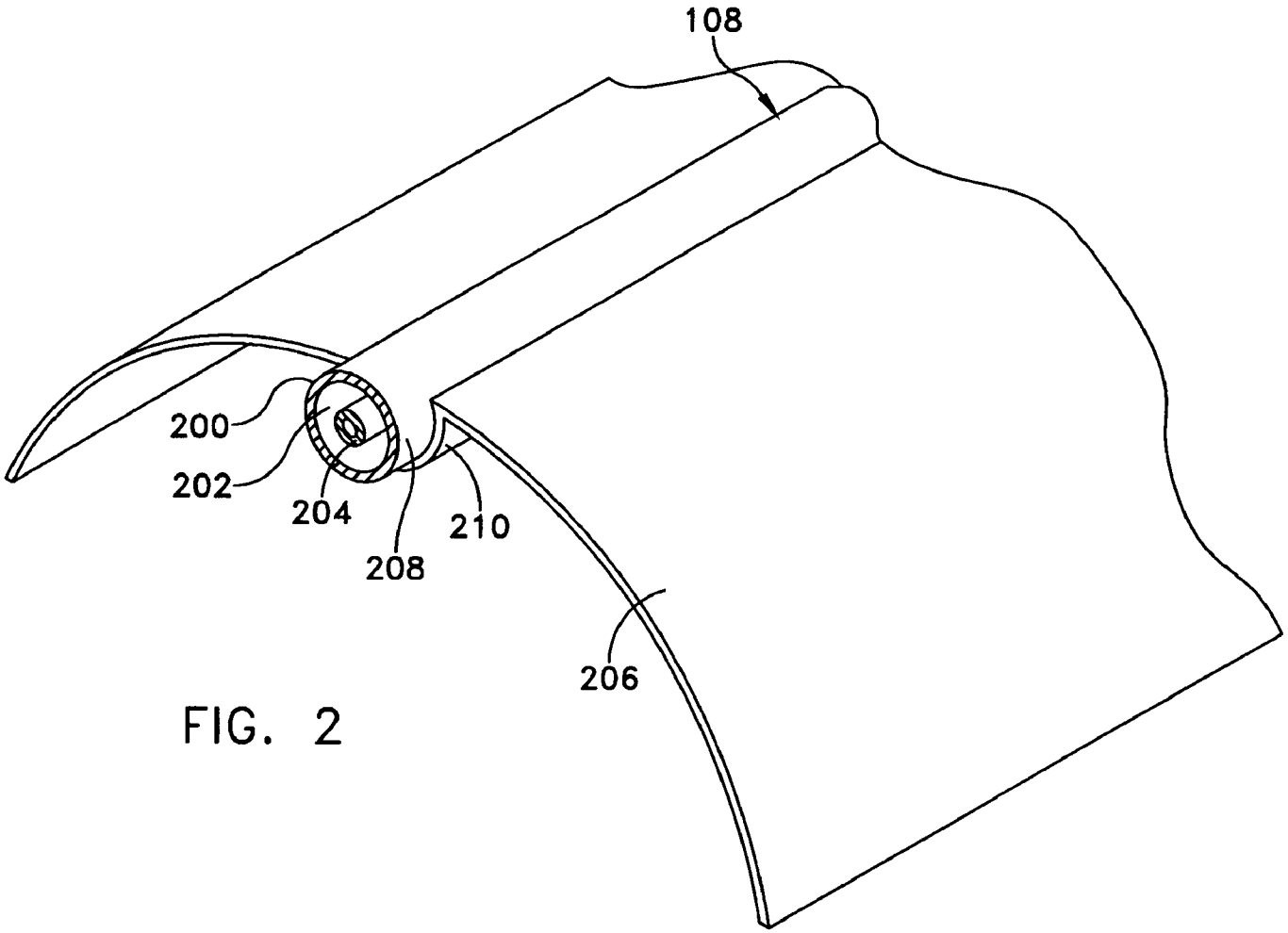
FIG. 2 is an enlarged view of a hollow fluid transport section of the condenser component disclosed by FIG. 1.

FIG. 2 discloses that each rigid section (108) has a heat transferring outer tube (200) providing a vapor line section for transporting vapor phase working fluid in an annular space (202) between the outer tube (200) and an inner tube (204) providing a liquid line for returning condensate to the compensation chamber (106). According to an alternative embodiment of the invention, the vapor and liquid lines are switched, such that the inner tube (204) is the vapor line, and the space (202) provides the liquid line for returning condensate.

FIG. 2 further discloses an embodiment of the invention having a thin, heat dissipating, external fin (206) in thermal communication with the exterior side (208) of each corresponding rigid section (108). For example, the external fin (206) is in thermal communication by being attached to the exterior side (208). The fin (206) is not easily deformed, and thus adds rigidity to the heat transferring tube (200). Heat is transferred and dissipated by conduction in the fin (206) as well as the side (208) of the tube (200) of the rigid section (108). The fin (206) has a channel portion (210) that conforms to the exterior side (208) of a corresponding rigid section (108). For example, the channel portion (210) and the exterior tube (108) are highly conducting, and are intimately joined, for example, by welding, brazing or conducting epoxy, to conduct and dissipate heat from the interior of the corresponding rigid section (108). The fin (206) is disclosed as a one-piece. Alternatively, the fin (206) can be formed by multiple pieces that are joined to the exterior tube (108). For example, subsequent to joining the fin (206) and the outer tube (200), the assembly (100) is plated for corrosion resistance. Alternatively, when the working fluid is corrosive, the outer tube (200) and the inner tube (204) are fabricated of corrosion resistant metal, for example, stainless steel. According to an alternative embodiment of the invention, the side (208) of each rigid section (206) dissipates heat sufficiently without one or more external fins (206).

In a heat pipe assembly (100), a vacuum tight envelope is provided by the length of the heat pipe assembly (100), from the evaporator (104) at the evaporator end, to the condenser (102) at the condenser end. The vacuum tight envelope contains a quantity of working fluid that establishes an equilibrium of liquid and vapor. Liquid phase working fluid flows from the compensation chamber (106) to the evaporator (104), where the equilibrium is upset by vapor that is generated by heat transferred to the working fluid by the evaporator (104). The vapor separates from the liquid in the evaporator (104). The vapor at slightly increased vapor pressure transports along the condenser (102) where the vapor gives up it latent heat of vaporization, causing condensate to form and enter the liquid line provided by the tube (204). The condensate returns to a reservoir of the compensation chamber (106).

The liquid line extends continuously along the rigid sections (108) and the bendable sections (110) to return condensate to the compensation chamber (106). The condenser rigid sections (108) and bendable sections (110) transport two-phase working fluid. Vapor phase working fluid is transported by the condenser (102), along the annular space (202), while heat is dissipated by conduction in the exterior sides (208) of the tubes (200) of the rigid sections (108), by the fins (206), and by the exterior sides of the bendable sections (110). The condensate returns via the liquid line to the compensation chamber (106), for example, by one or more, of, gravity, capillary fluid flow in the evaporator (104) and vapor pressure. Heat interchange between the vapor and the condensate is minimized by isolating the condensate in the liquid line, i.e., the tube (204), made of bendable material that is non-reactive and chemically compatible with the fluid. Under certain operating conditions, the tube (204) may transport vapor as well as the fluid, and is thereby, non-reactive and chemically compatible with the vapor. According to an embodiment of the invention, the tube (204) is made, for example, of polytetrafluroethylene, PTFE, formed into bendable tubing. Thermal insulation properties of the tube (204) provides insulation against thermal interaction between the vapor and the condensate.

Figure 3A:
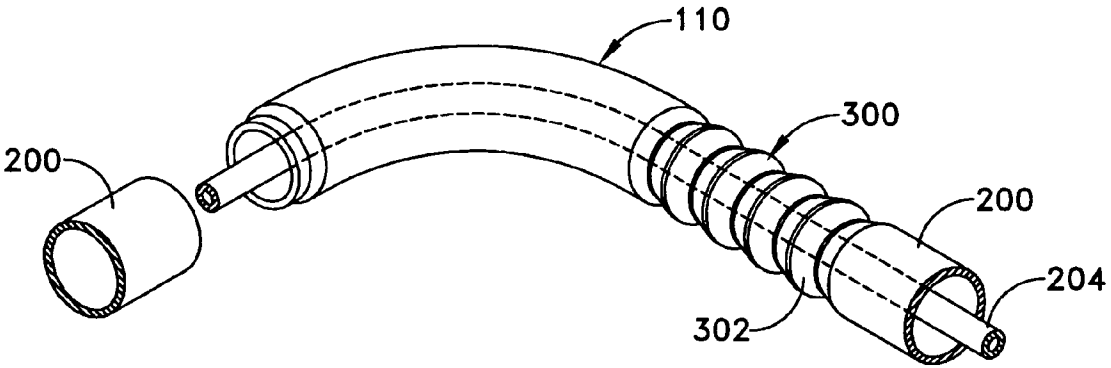
FIG. 3A is an enlarged view of a hollow bendable fluid transport section of the condenser component.

FIG. 3A discloses an embodiment of each condenser bendable section (110), which is made bendable by a hollow tubular bellows (300) providing the vapor line. The bellows (300) is flexible in addition to being bendable. Each open end of the bellows (300) couples with the outer tube (200) of a corresponding condenser rigid section (108) with an hermetic seal to provide a continuous vapor line. The bellows (300) has an hermetically sealed, continuous exterior side that has a series of pleats (302) extending between an enlarged diameter and a smaller diameter. The shape of the pleats (302) can vary. For example, the pleats (302) can be folded, or serpentine without folds. Further, the pleats (302) can be ring-like or spiral, for example. The pleats (302) can stretch, and can collapse to move farther apart and closer together, which allows the bellows (300) to bend and to further deform in torsion. Bending forces and torsion forces are distributed along the bellows (300) by movement of the pleats (302), which avoids rupture of the bellows (300).

Figure 5:
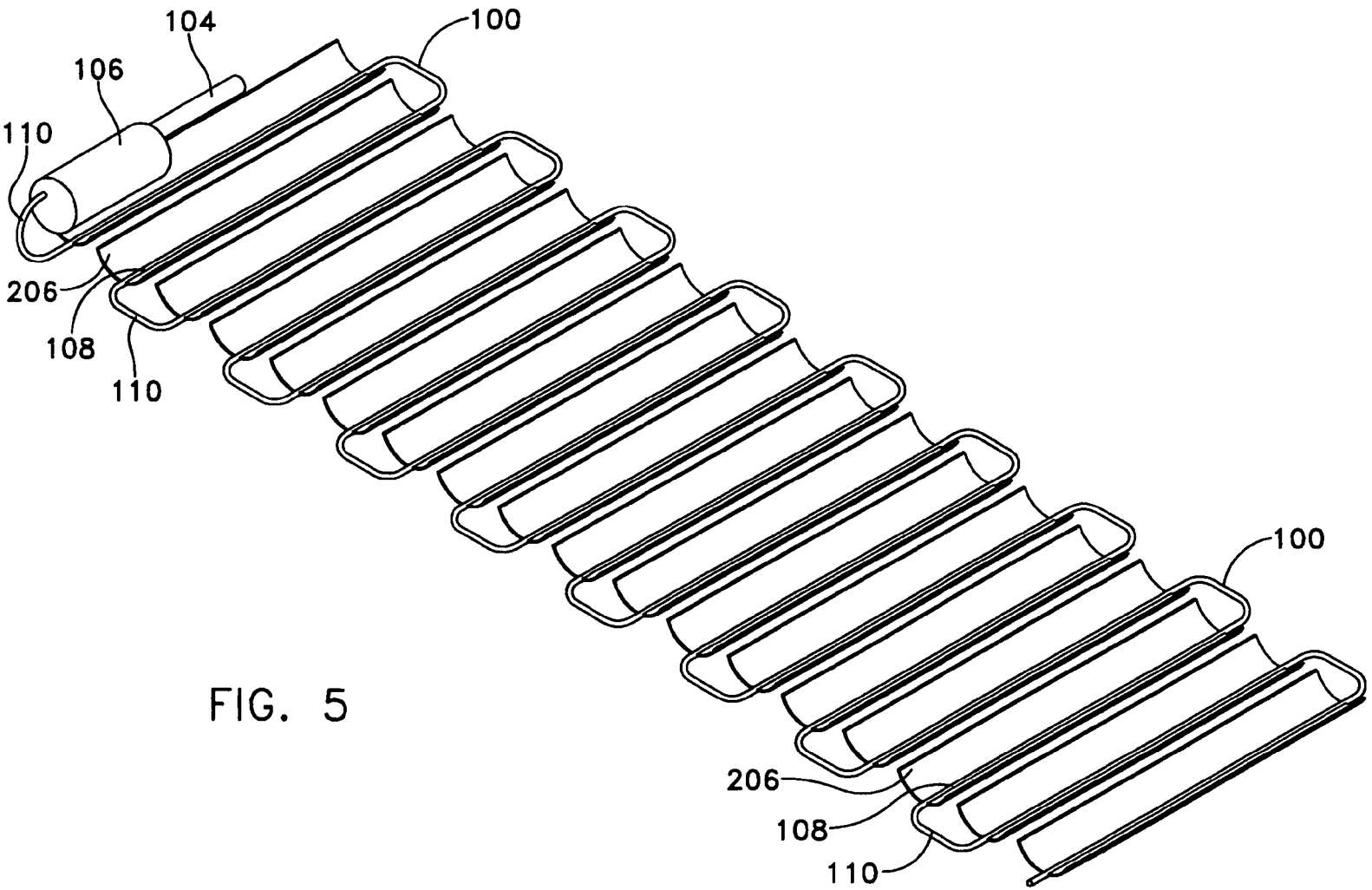
FIG. 5 is an isometric view of a heat pipe assembly with its condenser component folded in a serpentine configuration.

FIG. 5 discloses that the condenser (102) can assume a curvilinear configuration by bending the bendable sections (110). The particular curvilinear configuration disclosed by FIG. 5 has the condenser (102) bent into a serpentine configuration, with the elongated fins (206) being parallel and in series, and with the rigid sections (108) being parallel and in series, and with the bendable sections (110) being curvilinear. The bendable sections (110) become bent, when the elongated fins (206) are laid in series along a generally flat surface or flat plane.

Figure 3B:
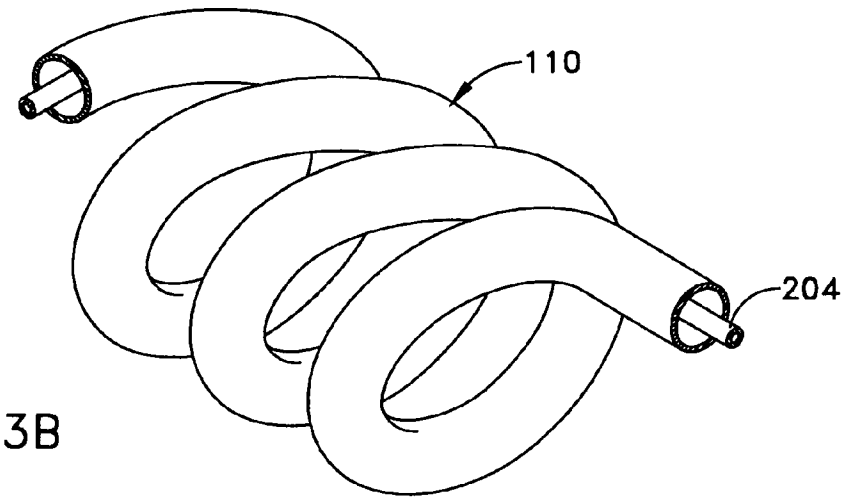
FIG. 3B is an enlarged view of another hollow bendable fluid transport section of the condenser component.

FIG. 3B further discloses another embodiment of the bendable section (110) that comprises annealed ductile metal tubing, for example, annealed copper tubing is satisfactory for exposure to non-corrosive working fluid, or annealed stainless steel tubing is resistant to a corrosive working fluid, for example, ammonia and its various compositions. The bendable sections (110) are pre-bent to the curvilinear positions, as disclosed by FIG. 5, and then annealed. Thereafter, the bendable sections (110) are ductile, and are suitable to be bent to a desired configuration until becoming work hardened.

FIG. 5 further discloses that the bendable section (110) between the compensation chamber (106) and the nearest condenser rigid section (108) has been bent to move the nearest rigid section (108) and the compensation chamber (106)-evaporator (104) combination in conformal registration with each other.

Figure 6:
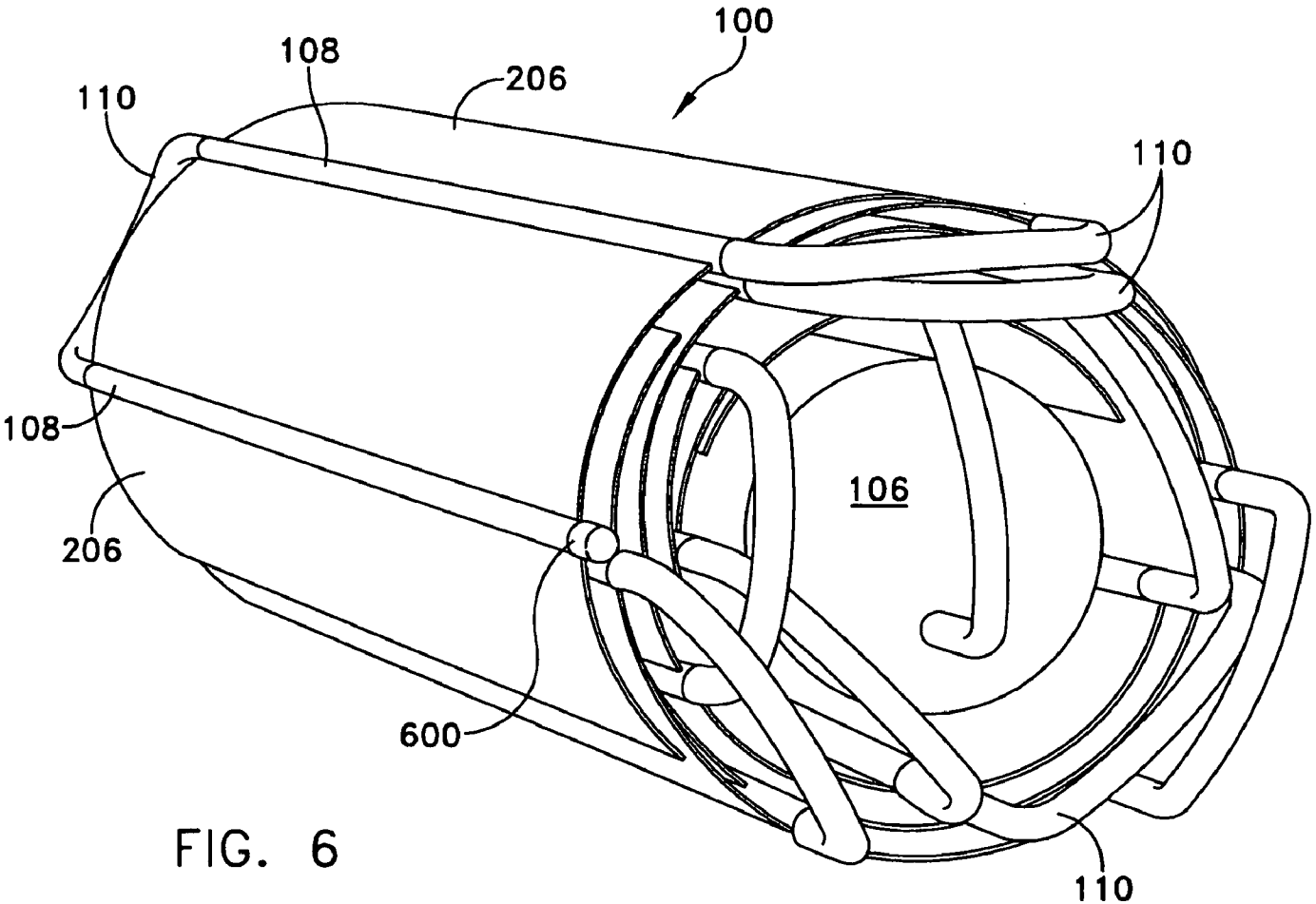
FIG. 6 is an isometric view of a heat pipe assembly in a compact configuration.

FIG. 6 discloses that the condenser (102) is rolled up, to wrap around the compensation chamber (106)-evaporator (104) combination, using the compensation chamber (106)-evaporator (104) combination as mandrel or core to roll up the condenser (102). Successive fins (206) are rotated into position to surround the compensation chamber (106)-evaporator (104) combination and the condenser (102), and form a compact, rolled-up assembly (100). As each fin (206) is rotated into position in the rolled-up assembly (100), the bendable section (110) connecting the subsequent fin (206) in the series will twist in torsion by an amount that is equal to, and out of phase with, the twist in torsion of the next bendable section (110) in the series.

In FIG. 6, the compact, rolled-up assembly (100) will fit in a compact package. For example, the rolled-up assembly (100) fits within a tubular volume that is set with a length limitation and a diameter limitation, which would be within limits set for a volume limitation. Multiple rolled-up assemblies (100) may be packaged and shipped, and then unpackaged and assembled together to build a radiator.

The fins (206) on corresponding condenser rigid sections (108) have been shaped to conform in shape to that of the compensation chamber (106)-evaporator (104) combination. In FIG. 6, the exterior shape of the compensation chamber (106)-evaporator (104) combination is curved cylindrical. Thus, for a cylindrical compensation chamber (106)-evaporator (104) combination, the fins (206) are curvilinear. The compensation chamber (106)-evaporator (104) combination may have an alternative shape, such as having flat exterior surfaces to which the fins (206) are shaped to conform to the alternative shape.

The fins (206) are curved with a slightly larger radius of curvature than that of the compensation chamber (106)-evaporator (104) combination, which allows stacking of the fins (206) in registration against the compensation chamber (106)-evaporator (104) combination. Further, successive fins (206) stack in registration against previous fins (206) in the rolled-up assembly (100). The successive fins (206) have successively enlarged radii of curvature to fit in stacked registration against prior fins (206) in the rolled-up assembly (100). According to an embodiment of the invention, each fin (206) can have a different radii. According to another embodiment of the invention, to simplify manufacturing, three different radii are used. Each fin (206) has one of three different radii depending on its relative position in the rolled-up assembly (100). The radius of curvature increases with the distance wrapped around the compensation chamber (106)-evaporator (104) combination.

FIG. 6 further discloses a condenser terminus (600). The terminus (600) is initially an open end of the outer tube (108) that has been evacuated to evacuate the heat pipe assembly (100), and the working fluid is introduced into an open end of the fluid line. Then the open end of the outer tube (108) is plugged by being fitted with a hermetic sealed plug or by being swaged or brazed or welded shut to form the terminus (600).

The heat pipe assembly (100) is adapted for subterranean imbedding, for example, to provide a portion of a radiator. Alternatively, the heat pipe assembly (100) is adapted for deployment by unfolding either by manual or remote manipulation in an atmosphere or in space. The heat pipe assembly (100) is adapted with or without a sub-cooler (400) disclosed by FIG. 4.

Figure 4:
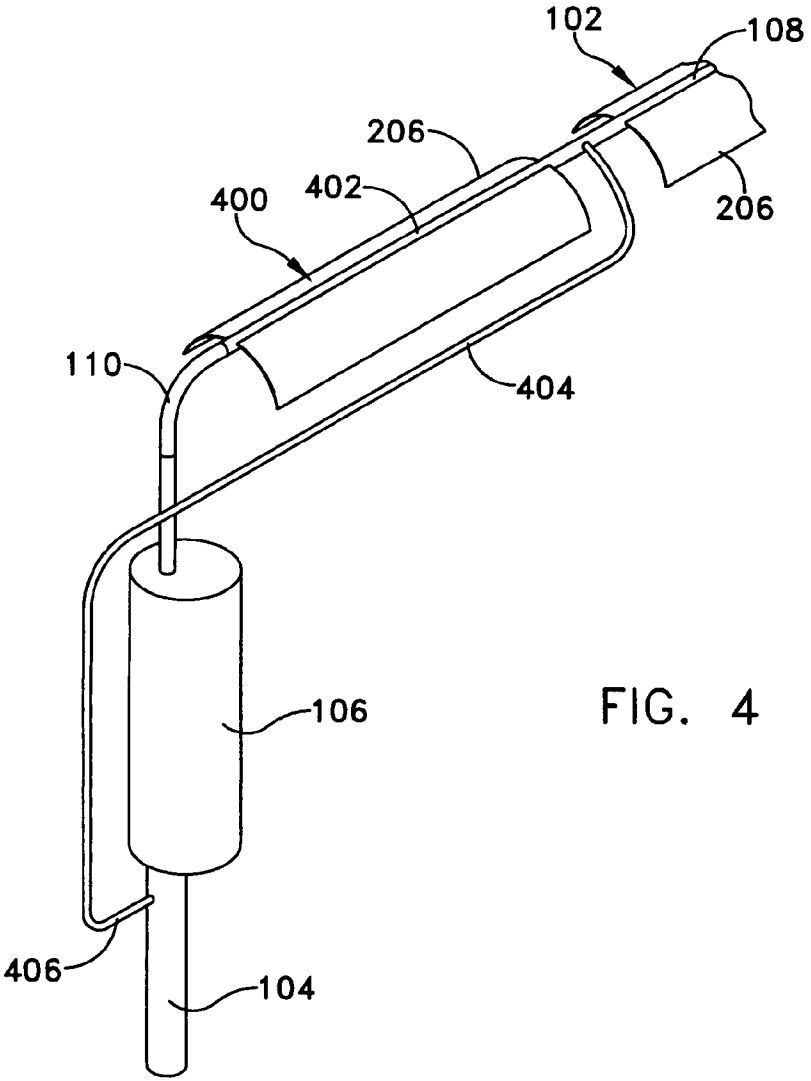
FIG. 4 is an isometric view of an evaporator in the heat pipe assembly disclosed by FIG. 1.

FIG. 4 discloses an embodiment of the invention, a sub-cooler (400) as a hollow fluid transport section component of the assembly (100). The sub-cooler (400) has an external liquid line section (402) with an external heat dissipating fin (206) extending from a hollow tubular section of the liquid line (402). The fin (206) is shaped to conform to the shape of the compensation chamber (106)-evaporator (104) combination, which allows stacking of the sub-cooler (400) in a small package volume, together with the compensation chamber (106)-evaporator (104) combination and the condenser (102). The sub-cooler (400) has its liquid line section (402) connected by a corresponding bendable section (110) to the interior of the compensation chamber (106). The length of the bendable section (110) determines how far away the sub-cooler (400) can be spaced from the compensation chamber (106). The heat pipe assembly (100) may have one or more sub-coolers (400).

The sub-cooler (400) has an hollow external vapor line section (404) to transport vapor phase working fluid externally of the external liquid line section (402), which avoids latent heat interchange between the vapor and the condensate. The vapor line section (404) connects to the interior of the evaporator (104) at a coupling (406) for transporting vapor from a vapor collection portion of the evaporator (104) to the condenser (102). The sub-cooler (400) separates the liquid line section (402) from the vapor line section (404), and dissipates heat from the condensate returning to the compensator (106), to sub-cool the condensate below its condensation temperature. In an alternative embodiment of the invention, the liquid line section (402) and the vapor line section (404) are switched.

Figure 7:
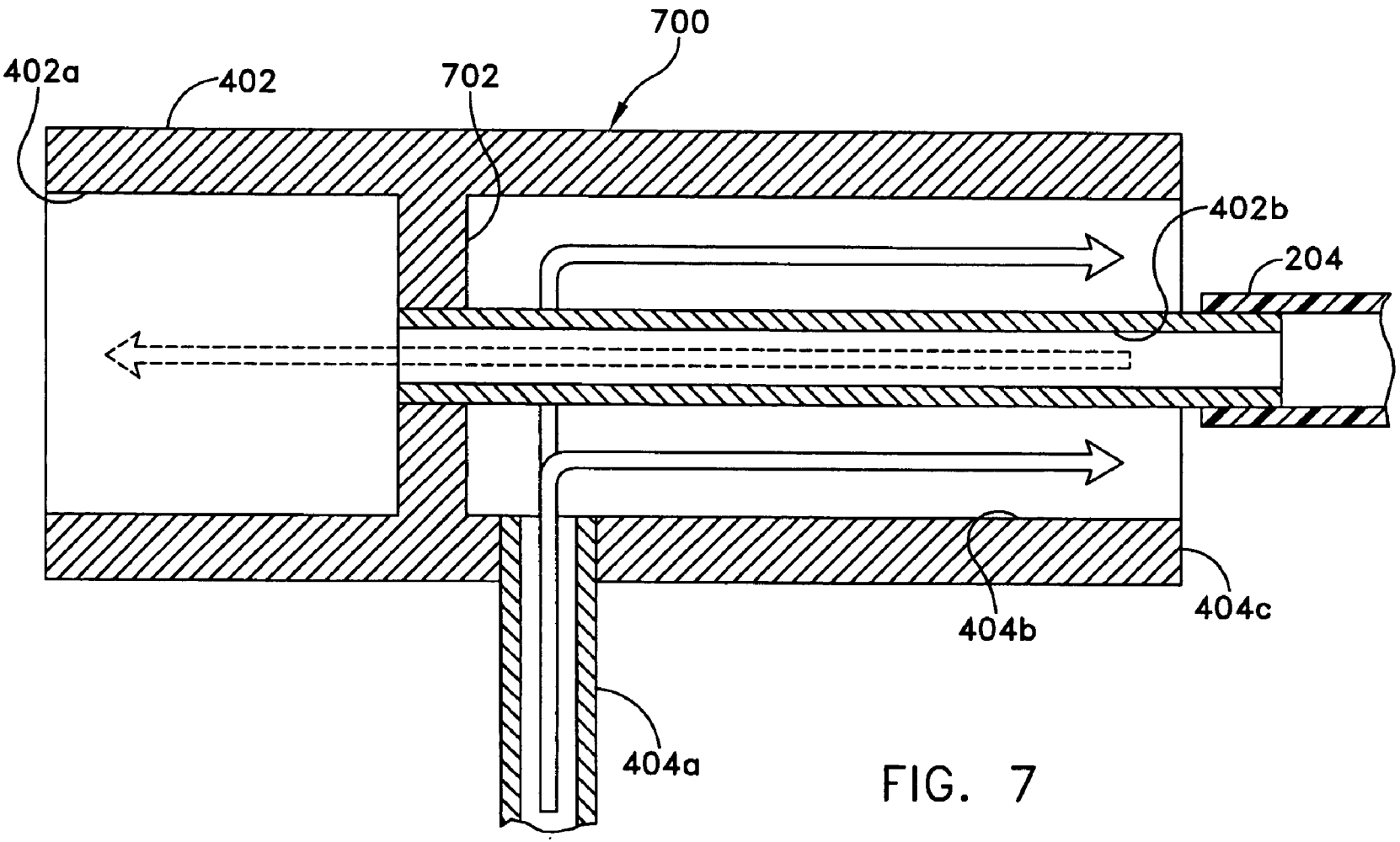
FIG. 7 is a section view of a tee manifold of a sub-cooler component of the heat pipe assembly disclosed by FIG. 1.

FIG. 7 discloses a coupling tee (700) that separates the liquid line section (402) from the vapor line section (404). The liquid line section (402) has an enlarged diameter liquid line section (402*a*) making a coupling connection with a corresponding bendable section (110). In turn, the corresponding bendable section (110) couples with the liquid line (402) of the sub-cooler (400). The liquid line section (402) has a reduced diameter liquid line section (402*b*) having a coupling connection with the liquid line tube (204) of the condenser (102). The liquid line section (402) transports condensate from the tube (204), through the corresponding bendable section (110) and to the compensation chamber (106). The coupling between (204) and (402*b*) does not require an hermetic seal. Thus the coupling is a liquid tight friction connection without an hermetic seal being necessary. When the sub-cooler (400) is not used in an embodiment of the invention, the liquid line section (402*a*) of the coupling tee (700) makes a coupling connection with the corresponding bendable section (110) shown in FIG. 4, and, in turn, the corresponding bendable section (110) couples to the compensation chamber (106).

An hermetic seal is provided between the exterior of the tee (700) and the vapor line section (404). The vapor line section (404) has a reduced diameter section (404*a*) and an enlarged diameter section (404*b*) concentric with the internal liquid line section (402*b*). The enlarged vapor line section (404*b*) is separated by an interior wall (702) from the enlarged liquid line section (402*a*). The enlarged vapor line section (404*b*) has an exterior end (404*c*) making a coupling connection with a corresponding bendable section (110) and then with the condenser (102).

With continued reference to FIG. 7, according to an alternative embodiment of the present invention, the coupling tee (700) would switch the vapor line section and the liquid line section. For example, a vapor line would connect the sections (404*a*) and (402*b*) to each other to form the vapor line. Further, a liquid return line would connect the sections (402*a*) and (404*b*) to each other, by eliminating the wall (702), to form a continuous liquid return line.

Although a preferred embodiment has been described, other embodiments and modifications of the invention are intended to be covered by the spirit and scope of the appended claims.

What is claimed is:

1. A component of a heat pipe assembly comprising:

hollow fluid transport sections communicating with hollow bendable fluid transport sections;

the bendable fluid transport sections being bendable to stack the rigid sections in a compact volume;

and further comprising a sub-cooler having an external condensate line section, and an external vapor line section, the external vapor line section communicating with a vapor line in the hollow fluid transport sections and in the bendable fluid transport sections.

2. The component of claim 1, and further comprising: fins on the hollow fluid transport sections.

3. The component of claim 1, and further comprising: a further flexible hollow fluid transport section connecting the component in a heat pipe assembly.

4. The component of claim 1, and further comprising: a liquid line extending through the hollow fluid transport sections and through the bendable fluid transport sections.

5. The component of claim 1, and further comprising: an exterior side of the hollow and bendable fluid transport sections dissipating latent heat of vapor phase fluid being transported.

6. The component of claim 1, and further comprising: an evaporator of a heat pipe assembly, the hollow fluid transport sections having a shape conforming to the exterior of the evaporator.

7. The component of claim 1, and further comprising: an evaporator of a heat pipe assembly; and a fin on each of the hollow fluid transport sections having a shape conforming to the shape of the exterior of the evaporator.

8. The component of claim 1, and further comprising: the component being a condenser of a heat pipe assembly.

9. A heat pipe assembly comprising:

a hollow envelope having an evaporator and a condenser containing a quantity of working fluid;

the condenser having hollow fluid transport sections communicating with hollow bendable fluid transport sections; the bendable fluid transport sections being bendable to stack the rigid sections in a compact volume;

and further comprising a sub-cooler having an external condensate line section, and an external vapor line section, the external vapor line section communicating with a vapor line in the hollow fluid transport sections and in the bendable fluid transport sections.

10. The heat pipe assembly of claim 9, and further comprising: fins on the hollow fluid transport sections.

11. The heat pipe assembly of claim 9, and further comprising: a liquid line extending through the hollow fluid transport sections and through the bendable fluid transport sections.

12. The heat pipe assembly of claim 9, and further comprising: an exterior side of each of the hollow and bendable fluid transport sections dissipating latent heat of vapor phase fluid.

13. The heat pipe assembly of claim 9, and further comprising: the hollow fluid transport sections having a shape conforming to the exterior of the evaporator.

14. A component of a heat pipe assembly comprising:

hollow fluid transport sections communicating with hollow bendable fluid transport sections;

the bendable fluid transport sections being bendable to stack the rigid sections in a compact volume;

and further comprising one of the hollow fluid transport sections having an external fin and providing a sub-cooler for condensate, and an external vapor line connected to a vapor collection manifold of a heat pipe assembly; the vapor line by-passing the sub-cooler and being connected to a bendable hollow fluid transport section that is, in turn, connected between the sub-cooler and an adjacent hollow fluid transport section.

15. A component of a heat pipe assembly comprising:

hollow fluid transport sections communicating with hollow bendable fluid transport sections;

the bendable fluid transport sections being bendable to stack the rigid sections in a compact volume;

and further comprising a coupling tee having a liquid line section between the fluid transport sections and a reservoir of a heat pipe assembly, and the coupling tee having a vapor line section between the fluid transport sections and an evaporator of a heat pipe assembly.

* * * * *